United States Patent [19]

Kakiuchi et al.

[11] Patent Number: 4,829,571

[45] Date of Patent: May 9, 1989

[54] HEADPHONE

[75] Inventors: Tsutomu Kakiuchi, Toda; Akinari Mori, Tokyo; Yoshio Ogawa, Yokohama, all of Japan

[73] Assignee: Sony Corporation, Tokyo, Japan

[21] Appl. No.: 579,108

[22] Filed: Feb. 10, 1984

Related U.S. Application Data

[63] Continuation of Ser. No. 276,245, Jun. 22, 1981.

[30] Foreign Application Priority Data

Jun. 20, 1980 [JP] Japan ..... 55-87393

[51] Int. Cl.[4] ..... H04R 5/00

[52] U.S. Cl. ..... 381/25; 381/74

[58] Field of Search ..... 179/167, 156 R, 185, 179/182 R, 182 A, 180, 107 R; 381/25, 74, 104, 109, 123, 67, 68, 72

[56] References Cited

U.S. PATENT DOCUMENTS

| | | | |
|---|---|---|---|
| 1,973,410 | 9/1934 | Greibach | 179/167 R |
| 2,002,504 | 5/1935 | Graham et al. | 179/167 |
| 2,574,887 | 11/1951 | Pye | 179/167 |
| 3,474,196 | 10/1969 | Bottos | 179/167 |
| 3,862,379 | 1/1975 | Pless | 179/167 |

*Primary Examiner*—Robert Lev

*Attorney, Agent, or Firm*—Hill, Van Santen, Steadman & Simpson

[57] ABSTRACT

A stereo headphone having left and right headphone units which are connected to a binaural input plug that has left and right input cords respectively connected between the left and right headphone units and wherein the right and left input cords are connected together in parallel between the binaural input plug and a predetermined intermediate point and with a muting switching device mounted at the intermediate point so as to allow muting of both headphone units under selected conditions.

2 Claims, 2 Drawing Sheets

HEADPHONE

This is a continuation, of application Ser. No. 276,245, filed June 22, 1981.

BACKGROUND OF THE INVENTION

1. Field of the Invention

This invention relates in general to headphones for a mobile apparatus and in particular for headphones for use with audio equipment.

2. Description of the Prior Art

Portable radio receivers and sound reproducers are often used by persons who are running or walking or otherwise listening to music. At times, the person using such apparatus wishes to hear other sounds such as spoken conversation from another person and with prior art devices in order to hear such conversations the person has had to take off the headphones so he can hear the conversation. Alternatively, in prior art devices the user may have to move from his listening location to the audio equipment to which the headphones are connected and operate a muting switch after physically moving to such equipment. This is troublesome and inconvenient for the user since he cannot immediately respond and hear the desired conversation.

SUMMARY OF THE INVENTION

It is an object of the present invention to provide an improved headphone set which makes it possible for a user to immediately mute it and respond to an audio signal.

Another object of the invention is to provide new headphones which allows a listener to immediately answer to a person speaking to him.

Yet another object is to provide a headphone with a muting switch which is easy and convenient to operate.

Yet another object is to provide a headphone with a muting switch which has simple wiring.

A headphone unit comprises left and right headphone units and a signal input terminal with an input cord connected between the signal input terminal and the left and right headphone units, respectively. Furthermore, a muting switch is provided at a predetermined position between the input terminal and the dividing point of the input cord which passes to the left and right headphones.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
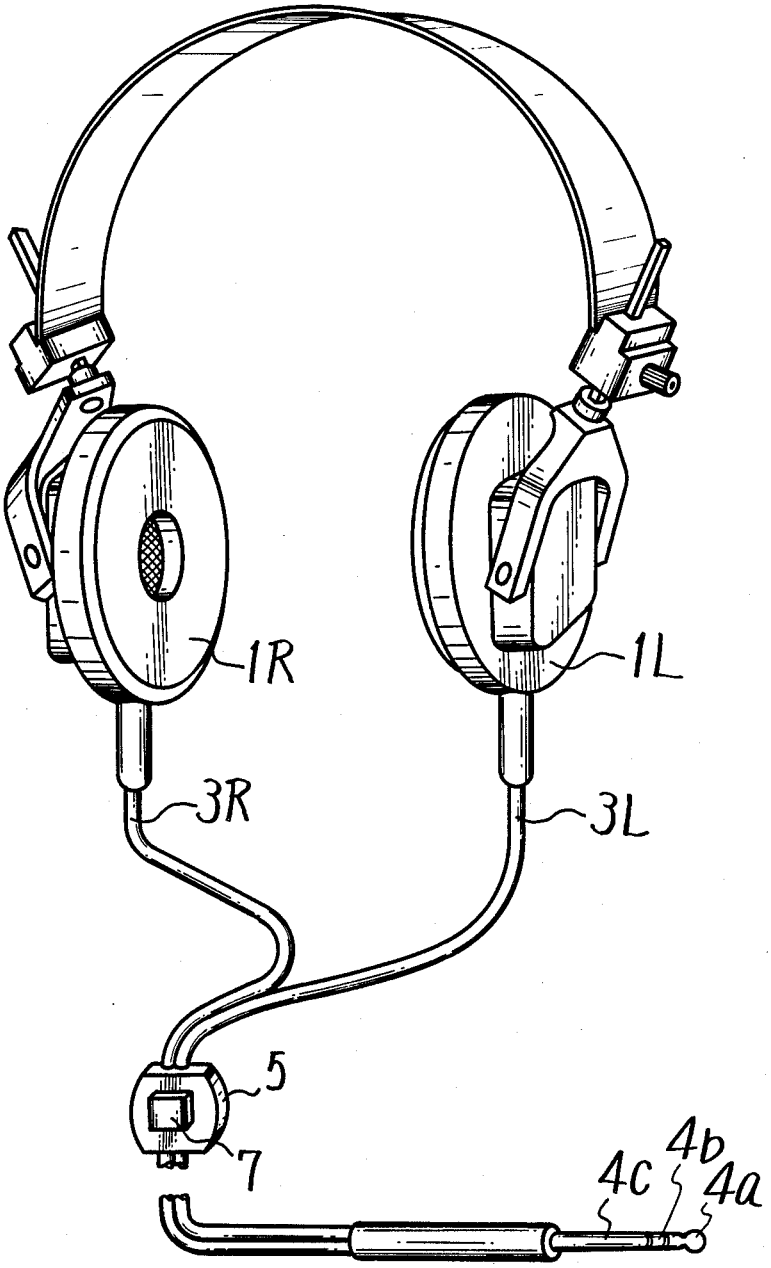
FIG. 1 is a perspective view illustrating a headphone according to the invention.

FIG. 1 illustrates a headphone set comprising a left headphone unit 1L and a right headphone unit 1R which are connected together by a suitable headband and left and right input cords 3L and 3R extend from the right and left headphone units and to an input plug 4. The input plug 4 has a left audio signal input terminal **4*a*, a right audio signal input terminal 4*b* and a common terminal 4*c*. The headphone units 1L and 1R** may be open air type for example.

Figure 2:
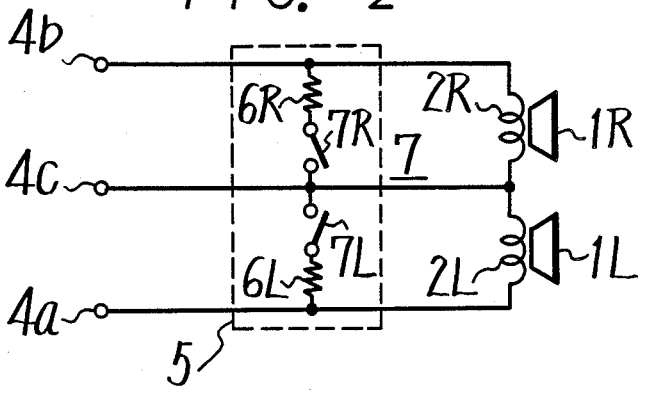
FIG. 2 is an electrical schematic showing a muting circuit employed in the headphone of FIG. 1.

As illustrated in FIG. 2, the voice coil 2L is connected between the left terminal **4*a* and the common terminal 4*c* of the plug 4 and the voice coil 2R is connected between the right terminal 4*b* and the common terminal 4*c***.

The headphone has a muting switch 5 mounting at a separation point of the input cords 3L and 3R. As illustrated in FIG. 2, the muting switch 5 includes a first resistor 6L of relatively low resistance as, for example, 0.5 ohms which has one side connected to one end of the audio coil 2L and the other end connected to a muting switch 7LL which has its other side connected to the common junction point between the speaker coils 2L and 2R. A switch 7R is connected from the common point to a resistor 6R which has its otherside connected to the second side of the voice coil 2R. Thus, the resistors 6L and 6R and switches 7L and 7R are connected respectively in parallel with the voice coils 2L and 2R. The switches 7L and 7R are normally open to allow the audio to pass to the voice coils and headphones and a switch actuating button 7 is mechanically connected to both the switches 7L and 7R so as to close such switches for muting operation. When the muting switch button 7 is released, the switches 7L and 7R open.

Figure 3:
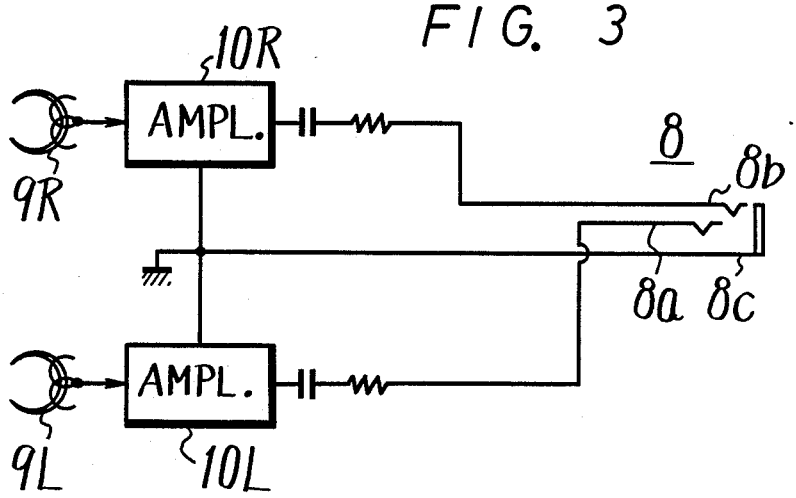
FIG. 3 comprises a circuit diagram of an example of an audio equipment for use with the headphone according to the invention.

FIG. 3 illustrates how the headphone according to the invention is connected to audio equipment, for example, a tape recorder. The input plug 4 is connected to a headphone jack 8 which has a left audio signal output terminal **8*a*, a right audio signal output terminal 8*b* and a common terminal 8*c* which respectively correspond to the left terminal 4*a*, the right terminal 4*b* and the common terminal 4*c* of the input plug 4. The left output terminal 8*a* is connected to a left reproducing magnetic head 9L through a left channel amplifier 10L and the right output terminal 8*b* is connected to a right reproducing magnetic head 9R through a right channel amplifier 10R**.

With a circuit connection as disclosed, when the switches 7L and 7R are open, the voice coils 2L and 2R of the headphone units 1L and 1R will be provided with left and right channel audio signals from the left and right channel amplifiers 10L and 10R at predetermined levels respectively. Thus, left and right channel sound will be reproduced from the left and right headphone units 1L and 1R.

On the other hand, when the switches 7L and 7R are closed by depressing the muting button 7, most of the left and right audio signals will be fed to the resistors 6L and 6R due to their low resistances and the left and right voice coils 7L and 7R will receive very little of the audio signals. Thus, the headphone units 1L and 1R will not reproduce the left and right channel signals under these conditions. Thus, by depressing the switch button 7 to close switches 7L and 7R will cause the audio to disappear from the headphone units 1L and 1R and muting will be accomplished.

Thus, when a listener is aware that someone is speaking to him as he listens to music or other audio from the headphones, he can simply provide muting of the music in the headphones by immediately depressing the switch button 7 so that he can hear the person speaking to him and can immediately respond. In the same manner, if a telephone rings or someone knocks at the door, it is not necessary for the user to take off the headphones or to move to an audio equipment to operate a muting switch since he can merely turn off the audio in the headphones by depressing the switch button 7 which is closely adjacent the headphones so that it is convenient for him to operate.

Figure 4:
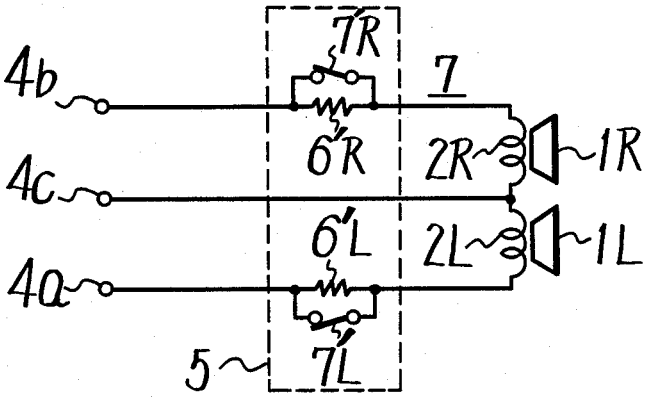
FIG. 4 is a circuit diagram illustrating a second embodiment of headphone according to the invention.

FIG. 4 illustrates a modification of the invention wherein a resistor 6'L is connected in series between point **4*a* and one end of the voice coil 2L and a muting switch 7'L is connected in parallel across the resistor 6'L. A resistor 6'R is connected between point 4*b* and one end of the voice coil 2R and a muting switch 7'R is connected in parallel with resistor 6'R. The resistance value of the resistor 6'L and 6'R is selected to be relative high as, for example, 680 ohms and the switches 7'L and 7'R are normally closed. Thus, in normal operation the resistor 6'L and 6'R are usually shorted by the closed switches 7'L and 7'R and only when the muting button 7 is pressed or the switches 7'R and 7'L opened so that the left and right audio signals must pass through the resistors 6'R and 6'L where they will be attenuated so as to render the output of the headphone units 1L and 1R** very low.

In the above example, the muting switch 5 is not restricted to be connected at the separation point of the input cords 3L and 3R, but it could also be provided at a selected position where the left and right input cords 3L and 3R are parallel together.

Also, the muting switch 7 need not be a mechanical switch but can also be an electrical touch type switch.

Other embodiments of the invention can comprise a switch in the series branch of the left and right channels without any resistors such that when the switches are closed the sound will pass through the speaker coil and when the switch is open no signal will be provided to the speaker coil.

Another embodiment could be where a single channel is utilized with a switch and a resistor in parallel with the speaker coil and a second resistor in series with the speaker coil with the series resistor being R1 and a parallel resistor being R2 and resistor R1 being much greater than resistor R2 and resistor R1 being less than the total input impedance to resistor R1 and the speaker coil.

Although the invention has been described with respect to preferred embodiments, it is not to be so limited as changes and modifications can be made which are within the full intended scope of the invention as defined by the appended claims.

We claim as our invention:

1. A stereo headphone comprising left and right headphone units of open air type, an input plug having left, right and common terminals, a left signal cord connected betwee said left terminal of said input plug and said left headphone unit, a right signal cord connected between said right terminal of said input plug and said right headphone unit, said left signal cord having a left signal conductor and a first common conductor and said right signal cord having a right signal conductor and a second common conductor electrically connected to said first common conductor, momentary muting switch means including a first normally open switch and a first resistor connected in series between said left signal conductor and said first common conductor and a second normally open switch and a second resistor connected in series between said right signal conductor and said second common conductor, a single momentary switch actuating button for momentarily closing said first and second normally open switches simultaneously so as to momentarily close the switches and momentarily insert said first and second resistors between said left signal conductor and said first common conductor and between said right signal conductor and said second common conductor for momentarily muting the left and right stereo signals which are supplied to said headphone units only when said momentary switch button is depressed, and a casing containing said first and second switches, said first and second resistors, and said momentary switch actuating button, and said left and right signal cords passing therethrough.

2. A stereo headphone comprising, left and right headphone units of open air type, an input plug having left, right and common terminals, a left signal cord connected between said left terminal of said input plug and said left headphone unit, a right signal cord connected between said right terminal of said input plug and said right headphone unit, said left signal cord having a left signal conductor and a first common conductor and said right signal cord having a right signal conductor and a second common conductor electrically connected to said first common conductor, momentary muting switch means including a first normally closed switch and a first registor connected in parallel between said input plug and said left headphone unit in said left signal conductor and a second normally closed switch and a second resistor connected in parallel between said input plug and said right headphone unit in said right signal conductor, a single momentary switch actuating button for momentarily opening said first and second normally closed switches simultaneously so as to momentarily open the first and second switches and to momentarily insert said first and second resistors in said left and right signal conductors only when said switch actuating button is depressed, respectively for momentarily muting the left and right stereo signals which are supplied to said headphone units, and a casing containing said first and second switches, said first and second resistors, and said momentary switch actuating button, and said left and right signal cords passing therethrough.

* * * * *